United States Patent [19]

Hannuniemi

[11] Patent Number: 4,676,735

[45] Date of Patent: Jun. 30, 1987

[54] FLUIDIZED BED COMBUSTION DEVICE FOR A SODA BOILER

[75] Inventor: Jukka Hannuniemi, Oulu, Finland

[73] Assignee: Rauma-Repola Oy, Kaarina, Finland

[21] Appl. No.: 746,066

[22] Filed: Jun. 18, 1985

[30] Foreign Application Priority Data

Jun. 19, 1984 [FI] Finland ..... 842464

[51] Int. Cl.[4] ..... F23D 19/00

[52] U.S. Cl. ..... 431/170; 422/143

[58] Field of Search ..... 431/7, 170; 122/4 D, 122/7 R, 7 C; 110/245; 162/30.1, 30.11; 34/57 R, 57 A; 422/139, 143, 145; 423/207, DIG. 16

[56] References Cited

U.S. PATENT DOCUMENTS 4,184,455 1/1980 Talmud et al. ..... 122/4 D
4,273,073 6/1981 Robinson ..... 122/4 D
4,292,023 9/1981 DeFeo et al. ..... 431/170
4,377,439 3/1983 Liem ..... 122/7 C X
4,424,765 1/1984 Strohmeyer ..... 122/4 D
4,542,716 9/1985 Drevilhe et al. ..... 122/4 D

FOREIGN PATENT DOCUMENTS 2128910 10/1972 France ..... 122/7 C

*Primary Examiner*—Margaret A. Focarino
*Attorney, Agent, or Firm*—Burns, Doane, Swecker & Mathis

[57] ABSTRACT

A fluidized combustion device that can be positioned inside the soda boiler of a cellulose factory and rapidly taken out of the boiler when it is desired to use the boiler as a normal soda boiler and as necessary again installed in the boiler.

3 Claims, 3 Drawing Figures

FLUIDIZED BED COMBUSTION DEVICE FOR A SODA BOILER

BACKGROUND OF THE INVENTION

The combustion of bark and other wood waste, flour fibres, lignite and other fuels burnt with difficulty is only really successful with the aid of a fluidised layer combustion device. This fuel has traditionally been either located separately beside the boiler proper from which hot combustion gases are led to heat up the boiler vaporiser and convection surfaces, or as a permanently constructed fixed unit in the bottom part of the boiler. In soda boilers in the vicinity of a cellulose factory use of the latter mentioned fluidised combustion device in this manner has not been possible since conversion of the boiler thereafter as a soda boiler could not be achieved. It has only been possible to use fluidised layer combustion devices when located beside a separate boiler.

The present invention eliminates the abovementioned drawback. In the present device the fluidised bed combustion device is built inside the soda boiler. The fluidising nozzles are detachably mounted on the air beams resting on the existing boiler base pipes. They can be, if required, rapidly removed and installed in place through the existing air feed openings in the side of the boiler firebox. These openings are blocked up by plastering in a closing door when the boiler is operating as a soda boiler.

BRIEF DESCRIPTION OF THE DRAWINGS

The operation and construction of the preferred embodiment are explained in the following by referring to the attached drawings.

DETAILED DESCRIPTION OF THE INVENTION

The capacity of the soda recovery boiler according to the embodiment is about 550 tons of dry substance/24 hours. It is intended as a reserve soda boiler in the case that the soda boiler proper suffers some longer term damage preventing its operation. Use of the boiler has been achieved for steam production with oil and bark fuel. The bark is burnt in the bottom of the firebox as a stack, using the oil burner in the back wall above, to dry, gasify and ignite the solid fuel in question. Combustion of bark heretofore has not been possible without the supporting combustion of the oil.

The construction according to the present invention raises the boiler solid fuel combustion capacity and also makes possible burning of coal or lignite and also the so-named flour fibres without oil being required as a supporting fuel. The boiler can be changed over for soda boiler use in 2–3 days.

Figure 1:
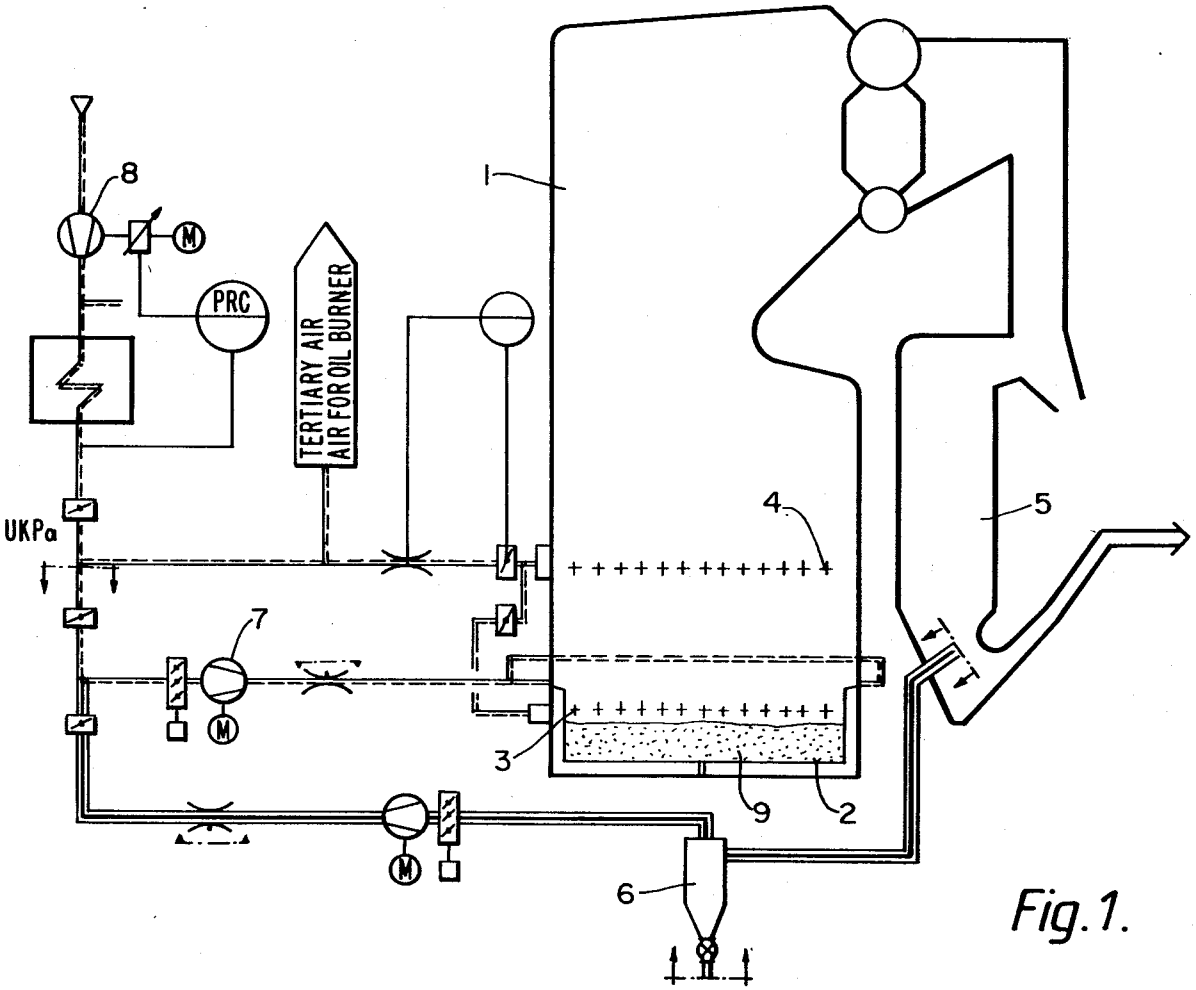
FIG. 1 illustrates the principle of operation of the boiler.
Figure 2:
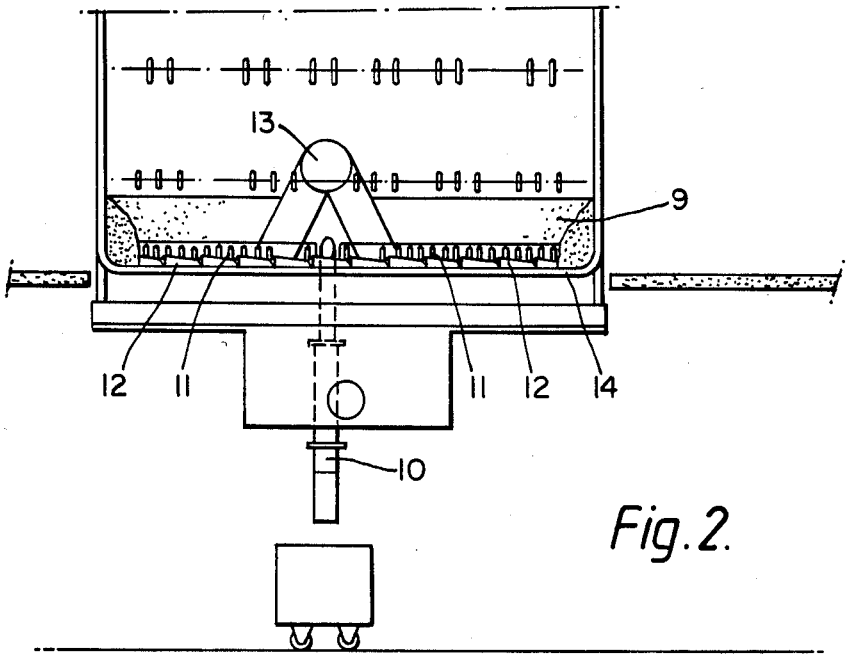
FIGS. 2 and 3 put forward constructional application of the device according to the invention.
Figure 3:
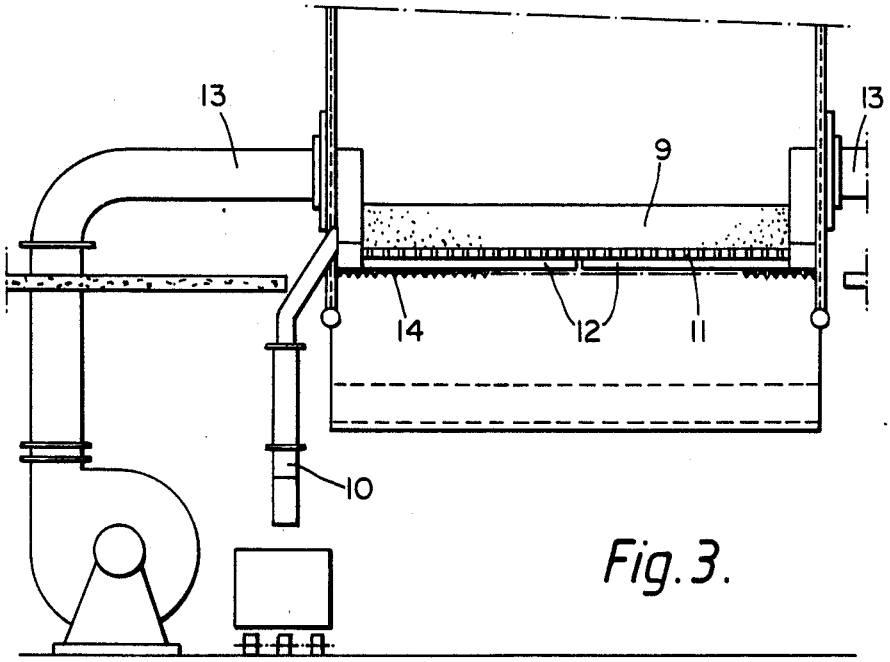

The firebox 1 of the boiler according to the invention is furnished with the device necessary for fluidised layer combustion as follows: Removable air ducting with its fluidising nozzles 2 (FIG. 1) is constructed on the firebox floor on top of base pipes 14 (FIG. 2). It is so constructed that it can be easily dismantled. The fluidised material in its static condition is a layer of sand and ashes about 350 mm deep. The upper surface of the layer to be fluidised is also below the level of the primary air outlets 3 during the fluidisation state and the primary air outlets can also be used as bottom secondary nozzles. The top secondary nozzles 4 function as the secondary nozzles proper.

In order that the temperature of the fluidised layer can also be governed during the combustion of coal (must be 700°–950° C.) the combustion system is equipped with facilities for using gas cycling. The circulation gas is taken after the feed water preheater 5 and drawn through the airbourne dust separation cyclone 6 to the fan and on into the fluidising air on the suction side of the fluidising fan 7. The quantity of gas circulating is controlled in accordance with fluidising temperature.

The air feed system is connected to the existing secondary air system so that the fluidising fan 7 is in series with the secondary air fan 8. The secondary air fan 8 is controlled according to constant pressure.

The start up of the boiler is performed with the aid of the oil burner in the rear wall, possibly making use of the existing support oil burners. The fluidising material 9 is heated above the ignition temperature of the fuel (for coal to about 550° C., for bark 350°–400° C.) after which feeding of solid fuel may be begun. When the bed temperature exceeds 750° C., the oil feed is lowered and in the end the oil burner can be completely extinguished.

The changeover to soda boiler use can be accomplished quickly. The fluidising material 9 can be removed through the ash extraction hatch 10 and the remainder of the sand drawn away through suction devices.

The fluidising nozzles 11 are mounted on the air beams 12, which may be rapidly taken away through the air feed openings 13 in the side walls. The air feed openings are then blocked by plastering in a closing door. The change to soda boiler use takes 2–3 days including boiler cool down.

If the air boxes known in the use of ordinary solid fuel fluidised layer combustion devices were to be used, this removal would not be possible without dismantling the boiler.

I claim:

1. A fluidised bed combustion device for a cellulose factory soda boiler, comprising: a boiler feedbox having air feed openings in a side of the feedbox; boiler base pipes; air beams resting on said base pipes for receiving air from said openings and removably installable through said openings; and fluidising nozzles for receiving air from said air beams and detachably mounted thereon.

2. The device as defined by claim 1, further comprising a fluidising fan connected in series with a secondary air fan.

3. The device as defined by claim 1, further comprising: a feed water preheater, a fluidising fan, and an airborne dust separator, wherein combustion gas from said combustion device is taken through said preheater and then drawn through said separator to a suction side of said fan.

* * * * *